US005851156A

United States Patent [19]

Schwark, Jr.

[11] Patent Number: 5,851,156

[45] Date of Patent: Dec. 22, 1998

[54] GOLF SWING TRAINING DEVICE AND METHOD

[76] Inventor: Orville J. Schwark, Jr., 6044 Westmoor, Shelby Township, Mich. 48316

[21] Appl. No.: 773,139

[22] Filed: Dec. 26, 1996

[51] Int. Cl.[6] ..... A63B 69/36

[52] U.S. Cl. ..... 473/201; 473/227; 473/228; 473/238; 473/268; 473/409

[58] Field of Search ..... 473/220, 201, 473/227, 228, 238, 268, 226, 409; 434/252

[56] References Cited

U.S. PATENT DOCUMENTS

| | | | |
|---|---|---|---|
| 3,863,933 | 2/1975 | Tredway | 473/220 |
| 5,310,188 | 5/1994 | Hernberg . | |
| 5,415,406 | 5/1995 | Reichenbach et al. . | |

*Primary Examiner*—George J. Marlo

*Attorney, Agent, or Firm*—Vanophem Meehan & Vanophem, P.C.

[57] ABSTRACT

A golf swing teaching aid designed to be removably attached to a golf club grip and having a planar member with an opening that encircles the golf club grip and the golfer's hands gripping the club, such that the planar member does not interfere with the golfer's hands or swinging of the golf club. The planar member attaches to the grip at two points, preferably with a friction fit, and locates the edges of the planar member about the grip aligning the planar member with the longitudinal axis of the club. The golfer's hands are located within the opening of the planar member and normally wrap around the grip. The planar member includes a highlighted or contrasting edge to aid the golfer in observing and assessing the position and alignment of the golfer's hands and the golf club face during the swing. The planar member provides the golfer or an instructor with an instantaneous visual picture of the true hand position and swing plane of the golfer's swing to provide for correction of the golf swing.

12 Claims, 4 Drawing Sheets

GOLF SWING TRAINING DEVICE AND METHOD

BACKGROUND OF THE INVENTION

1. Field of the Invention

The present invention relates generally to a device for use as an aid in teaching a proper golf swing. More particularly, the present invention relates to a teaching aid that can be easily attached to, and removed from, a grip region of a golf club without interfering with the golfer's swing while providing an accurate, instantaneous visual representation of the position and alignment of the golf club and hands as well as the true plane of the golfer's swing.

2. Description of the Prior Art

Golf swing teaching aids have been in use for a very long time, and there are a variety of teaching aids that attach to the shaft of a golf club to aid a golfer. One such aid is disclosed in U.S. Pat. No. 5,310,188, awarded to Hernberg, which discloses a teaching aid comprising a plurality of fins about a hub. The Hernberg reference teaches that the hub attaches to the shaft of the golf club as close as possible to the club head. A weight may be secured to one of the fins to help the golfer build up strength and endurance to improve and strengthen the golf swing.

The Hernberg reference discloses that the fins of the training aid have a large surface area to provide a resistance during the golfer's swing. This resistance is not appropriate for all training conditions, since it interferes with the golfer's natural swing thereby requiring the golfer to compensate to overcome the added resistance. A golfer seeking a visual picture of his swing to determine if any adjustments need to be made, and not necessarily to increase strength, would not get an accurate picture and feedback of his swing.

A teaching aid similar to Hernberg is disclosed in U.S. Pat. No. 5,415,406 awarded to Reichenbach et al. The Reichenbach et al. patent relates to devices used to improve a golfer's strength and endurance, and for use in warming up before a round of golf. Reichenbach et al. disclose an air-resistance wing that is attached to the shaft of a golf club as close as possible to the club head. The golfer swings the club at any desired speed with the air-resisting wing in place causing the golfer to use extra effort. Accordingly, the golfer must adjust his swing to overcome the resistance created by the Reichenbach et al. device. Thus, a golfer is not able to determine the true swing plane of the club when using an air-resistance wing. The golfer must constantly adjust the mechanics and geometry of the swing while using the air-resistance wing to overcome the uneven resistance added by the wing.

Thus, it is not possible for a golfer who wishes to get an accurate visual picture of the swing plane of the club to make improvements using the known devices. There is a need for a golf teaching aid which provides the golfer with visual feedback relating to the mechanics and geometry of the golfer's swing including the positioning of the club and hands during the back-swing and follow-through without interfering in any way with the swing. Furthermore, such a teaching aid must be compatible with a variety of golf clubs.

It is a purpose of the present invention to provide a device which will overcome the above mentioned and other problems associated with the prior art designs of golf teaching aids.

SUMMARY OF THE INVENTION

The present invention relates to a device that aids in training a golfer to develop a controlled and correctly positioned swing without interfering in any way with the mechanics and geometry of the golfer's swing. The present invention provides instant visual feedback to the golfer without requiring any physical adjustments during the swing to overcome resistance added by the teaching aid.

The device of the present invention attaches to the grip region of a golf club and allows the golfer to grip the club in a normal fashion. The teaching aid is shaped and aligned on the club such that it does not create a minimum resistance during the golfer's swing allowing the golfer to get a true feel of the golfer's swing while having instantaneous visual feedback of the positioning and alignment of the club. The present invention is designed to be compatible with any golf club and golf club grip and allows the golfer to improve on the finer points of the swing while using any club.

The present invention also includes a method of using a training device to teach a golfer to properly swing a golf club. The golfer attaches the device to the club and can stop his or her swing at any point during the swing and easily determine the position and alignment of his or her hands, the teaching aid and the club to make necessary corrections to perfect the golf swing.

Accordingly, the teaching aid of the present invention allows an instructor to more readily see exactly how a student's hands and club face are positioned throughout the student's swing.

Other objects, features and advantages of the invention will become more apparent from a reading of the following detailed description taken in conjunction with the drawings appended hereto.

DETAILED DESCRIPTION OF THE PREFERRED EMBODIMENT

Figure 1:
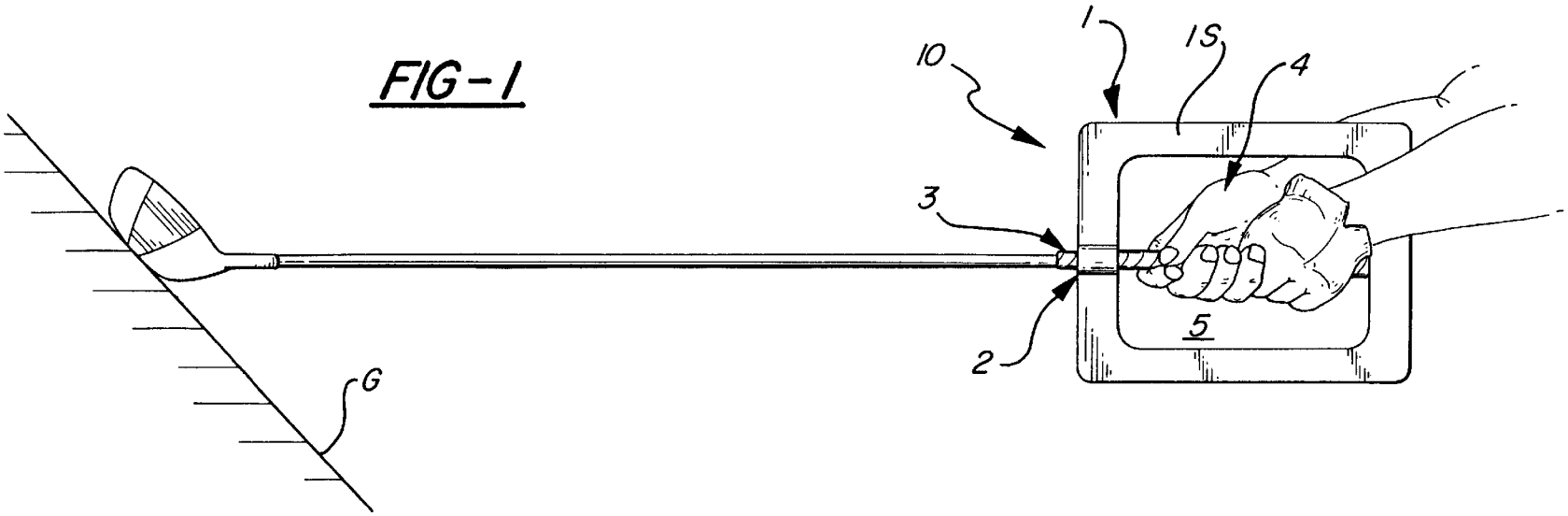
FIG. 1 is a side view of the teaching aid of the present invention located about a golf club grip with the golfer's hands positioned within the teaching aid wherein the club is shown relative to the ground.

Referring to FIG. 1, there is shown a teaching aid 10, according to the preferred embodiment of the present invention. The teaching aid 10 includes a planar member 1 and a preferably U-shaped receptacle 2 unitarily molded with the planar member 1 to secure the teaching aid 10 to a golf club grip 3 located on a golf club 12, as more fully described below. The planar member 1 is preferably made of a lightweight, durable and rigid material, such as an ABS, PC, nylon or blended plastic material. The planar member 1 has a general overall ring shape and preferably attaches to the grip 3 at two points. The planar member 1 has an opening 5 which allows a golfer to normally grip the golf club 12 as the club would be held without the teaching aid 10 attached to the club grip 3. The golfer's hands 4 are located within the opening 5 of the planar member 1 and normally wrap around the grip 3 using any known golf grip such as a Varden v-grip, an overlap grip or a baseball-style grip. The teaching aid 10 is designed such that it will preferably, in no way, interfere with the golfer's hands 4 during the golfer's swing.

Figure 2:
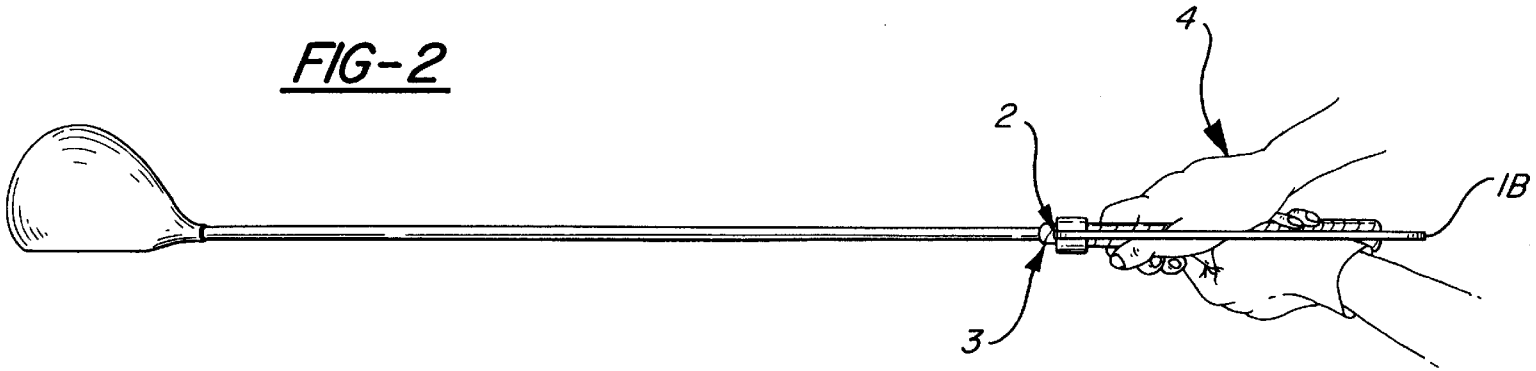
FIG. 2 is a top view of the teaching aid of the present invention connected to a golf club grip with the golfer's hands positioned within the teaching aid.

The planar member 1 includes an upper edge 1A and a front edge 1B as best shown in FIG. 2. The edge 1A' is similar to the edge 1A and performs the same function but for a left-handed golf swing. The edges 1A and 1B preferably have a very bright, easily noticeable color such as black, bright red or orange color, which will stand out and highly contrast with any background colors. Furthermore, the color on the edges 1A and 1B is preferably different and highly contrasted with the color of sides 1S and 1S' of the planar member 1. The sides 1S and 1S' are preferably very neutral in color, i.e. white, but may be any color which contrasts with the edges 1A, 1A' and 1B. Additionally, it is possible to have the side 1S a different color than the side 1S' so the golfer can specifically identify the direction of a change in orientation of the teaching aid 10 and golf club 12. The highly contrasting color on the edges 1A, 1A' and 1B help the golfer to more readily and easily determine the specific orientation of the planar member 1, and thus the club 12, during the golf swing.

Figure 6:
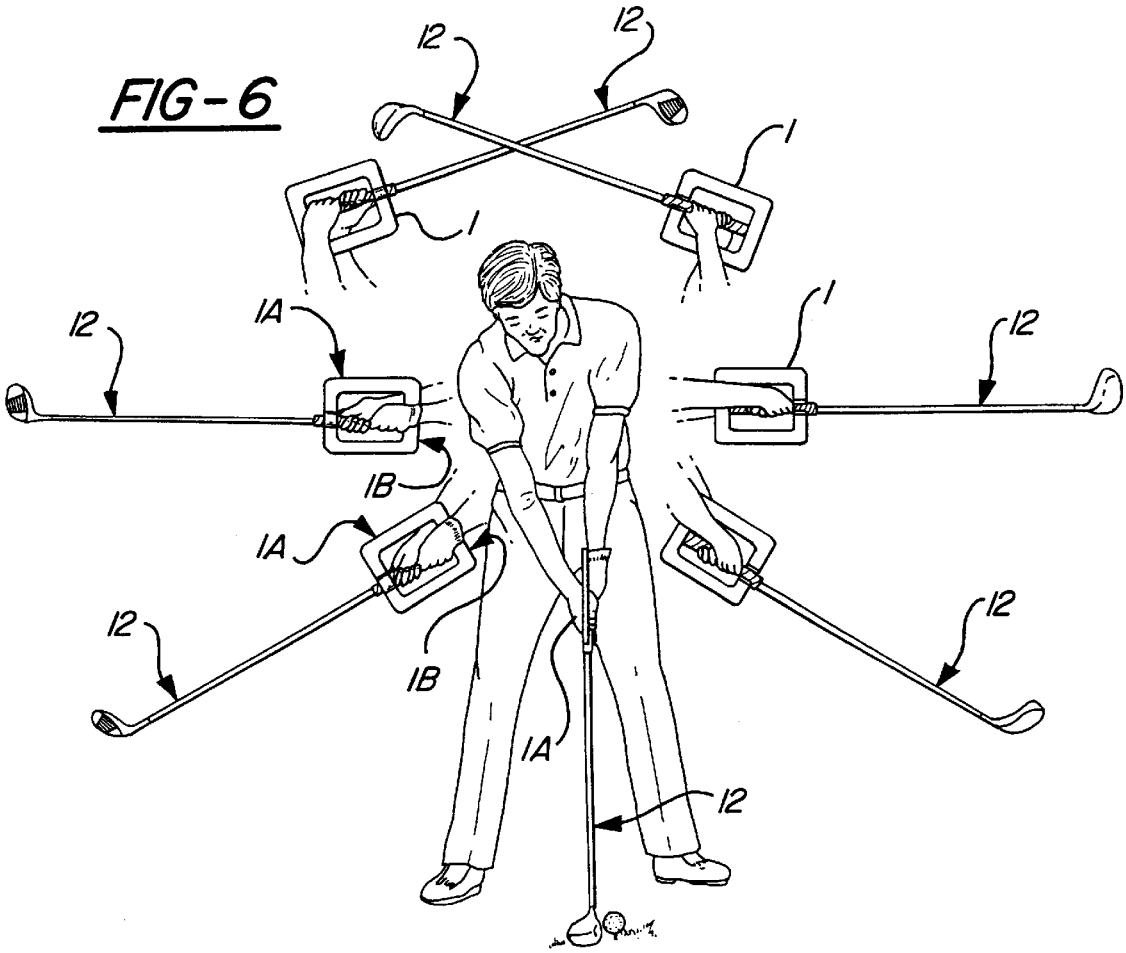
FIG. 6 is a view of the relative positions of the teaching aid of the present invention with respect to the club and the golfer's hands throughout one type of swing.

The planar member 1 is preferably connected to the golf club 12 once the club 12 is properly aligned to address the ball. In this position, the teaching aid 10 is substantially perpendicular with the ground when the golfer is properly setup and aligned for beginning the golf swing. When the teaching aid 10 is properly positioned on the club grip 3, such that the edges 1A and 1A' are aligned with the longitudinal axis of the shaft of the club 12, the golfer preferably sees only edges 1A (1A' for a left-handed swing) and 1B of the teaching aid as shown in FIGS. 2 and 6 and will not see the sides 1S and 1S' of the planar member 1.

The teaching aid 10 of the present invention is preferably connected, or removably attached, to the golf club 12 using a unique attachment means. However, it is possible to use many different attachment devices for retaining the teaching aid 10 on the golf club 12 provided the attachment device locates the edges 1A, 1A' and 1B about the grip 3 and aligned with the longitudinal axis of the club 12.

Figure 7:
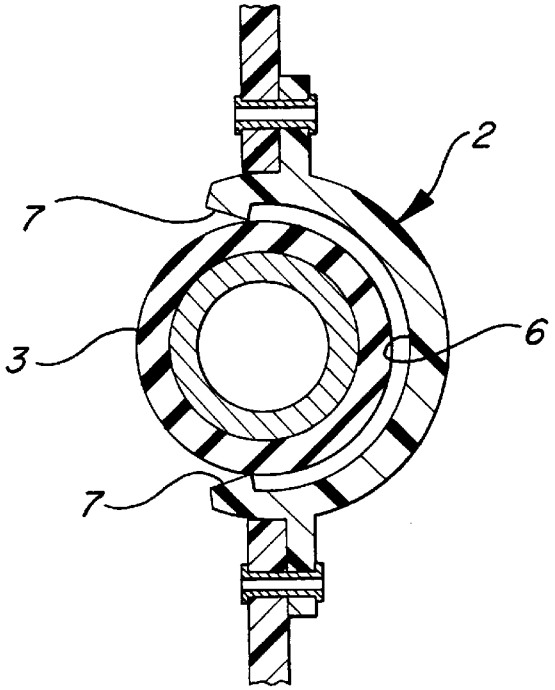
FIGS. 7 and 8 show alternate embodiments.

The teaching aid 10 is connected to the club grip 3 utilizing the receptacle or clip 2 of the teaching aid 10. Thus, the planar member 1 is secured to the club grip 3 by means of an interference fit between the receptacle 2 and the club grip 3. The receptacle 2 preferably includes unitary sides or tabs 2A and 2B that extend approximately perpendicularly from each leg of the U-shaped receptacle 2 for opening the receptacle 2 to remove the aid 10 from the grip 3. The tabs 2A and 2B are preferably made integral and unitary with the planar member 1. However, any type of connection may be used such as a rivet or any other suitable attachment method and means known in the art as shown in FIG. 7

The planar member and the tab 2A and 2B are molded from a flexible, resilient and strong plastic, or other suitable resilient material, having a diameter which is slightly larger than the diameter of the grip 3 when not connected to the golf grip 3. An inner diameter 6 of the U-shaped receptacle 2 is preferably provided with inwardly facing projections 7 integrally molded thereon. The inwardly facing projections 7 have a ramped design to retain the planar member 1 to the club grip 3 when the teaching aid 10 is placed thereon. Thus, when the receptacle 2 is pressed on the golf grip 3, the legs or sides of the U-shaped receptacle 2 expand about the golf grip 3 and once the golf grip is located within the bight portion of the U-shaped receptacle, the natural resiliency of the legs and the inwardly facing projections 7 create an interference fit between the golf grip 3 and the receptacle 2 connecting the distal end of the planar member 1 to the golf grip 3. The tabs 2A and 2B are located on the receptacle's end and are engaged by the user to expand the receptacle 2. The user pushes the tabs 2A and 2B apart so the projections 7 release from the grip 3 to remove the teaching aid 10. It should be noted that almost any type of connection can be used to hold the teaching aid 10 to the grip 3.

Figure 3:
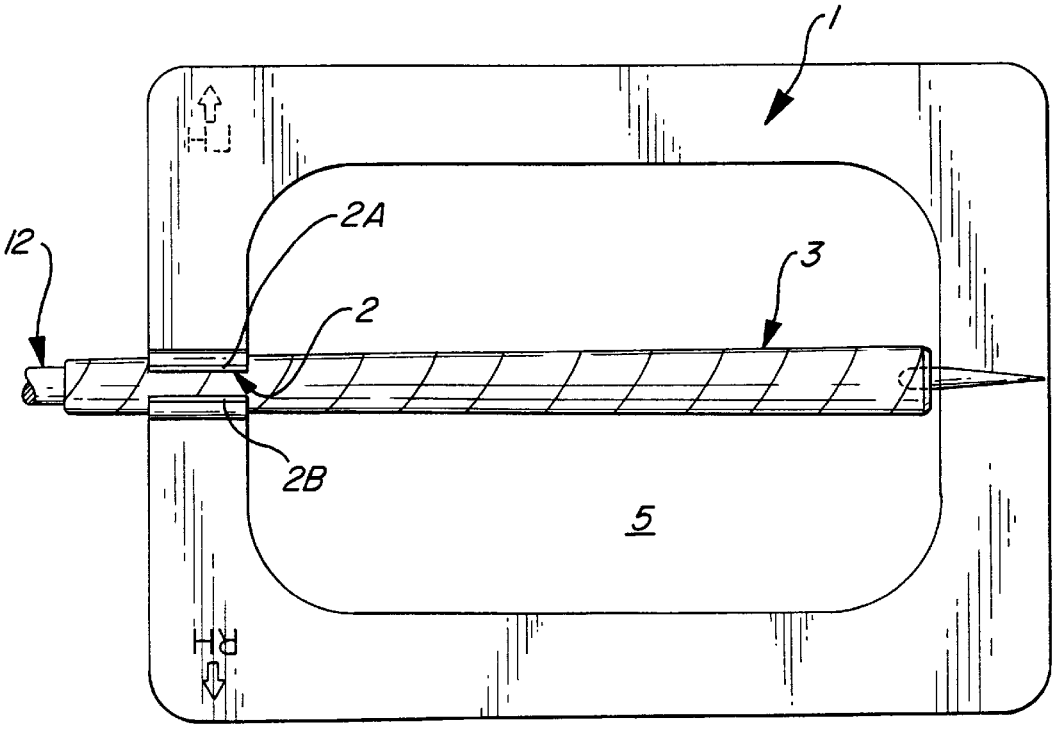
FIG. 3 is a side view of the teaching aid of the present invention detailing the connection to the teaching aid to the golf club grip at the snap on area.
Figure 4:
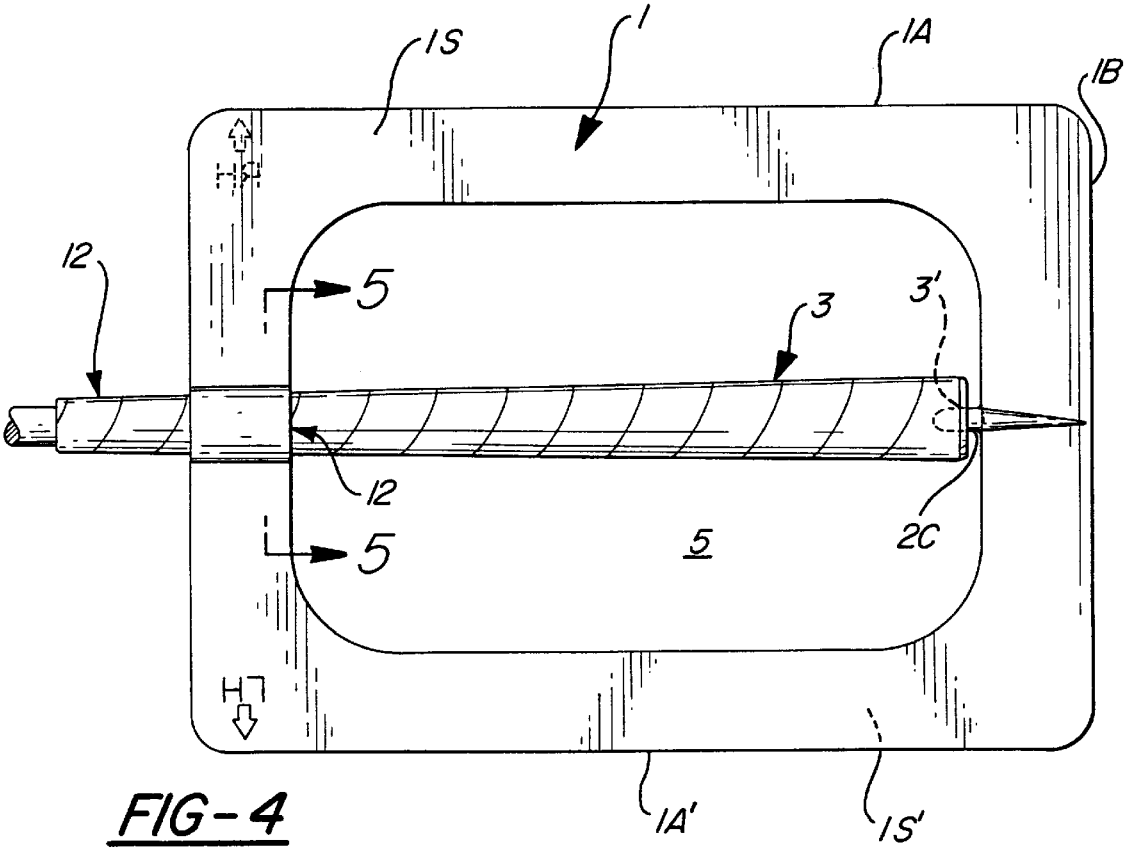
FIG. 4 is a side view of the teaching aid of the present invention connected to the golf club grip according to the preferred embodiment of the present invention looking at the side of the teaching aid facing the direction of flight for a right-handed golfer.
Figure 5:
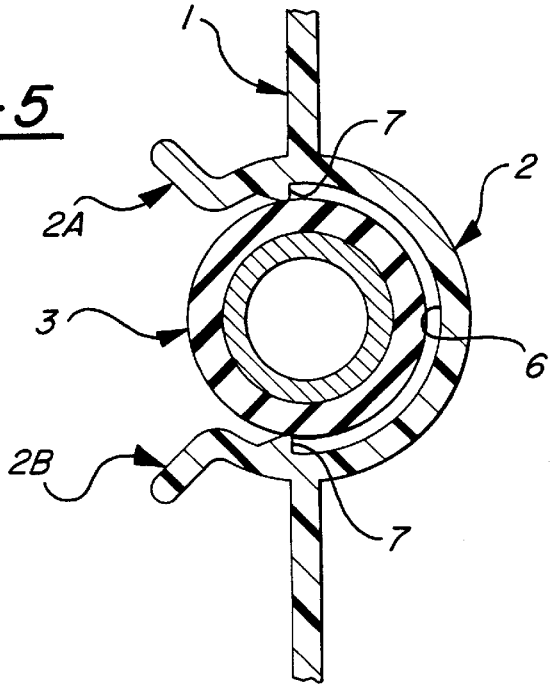
FIG. 5 is a cross-sectional view of the teaching aid of the present invention taken along line 5—5 of FIG. 4.

The teaching aid 10 is also provided with left-hand and right-hand designations, including arrows, as best shown in FIGS. 3 and 4. The arrows help orientate the teaching aid 10 depending upon the type of swing so the forces acting on the receptacle 2, during the swing, act against the inner diameter 6.

Figure 8:
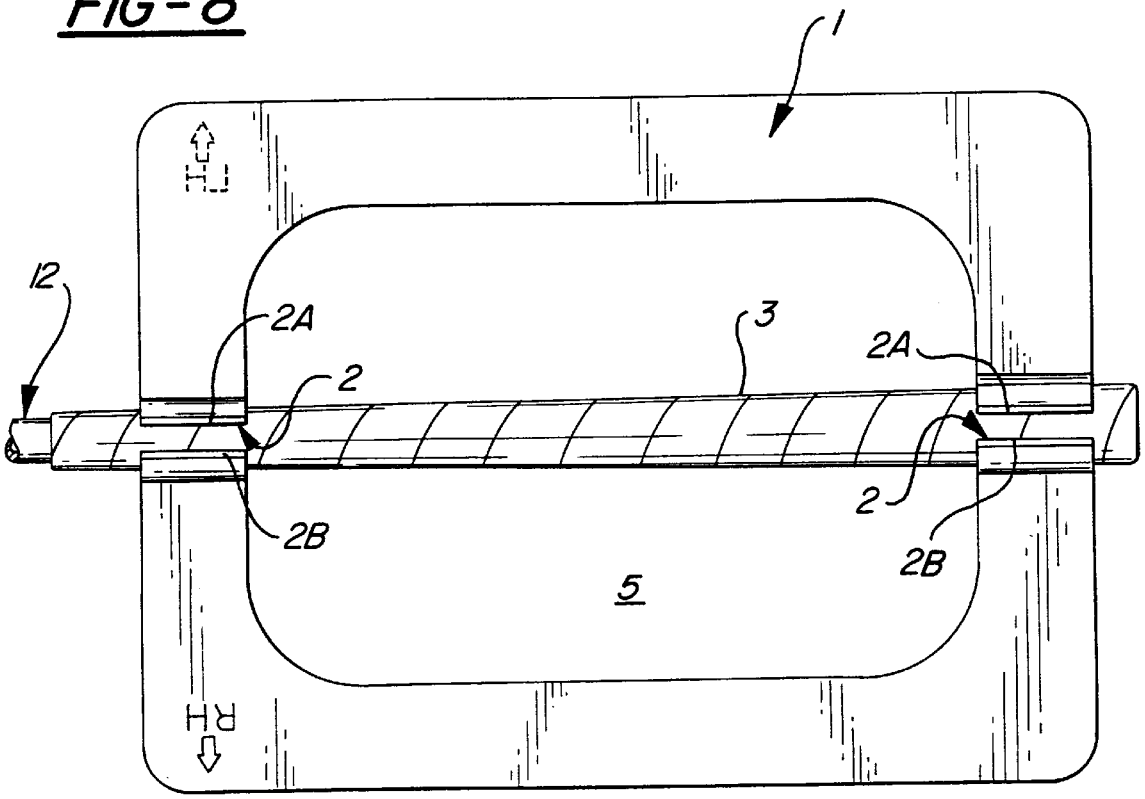

The golf grip 3 preferably has a hole 3' in the end proximal the golfer. The teaching aid 10 includes as an integral part of the planar member 1, and preferably as a unitary part thereof, a tab 2C located near the proximal end thereof. The tab 2C further defines the opening 5 of the teaching aid 10. The tab 2C, as shown in FIG. 4, attaches to the hole 3'. The tab 2C is preferably a unitary extension of the planar member 1 and extends inwardly from the planar member 1 into the opening 5 of the planar member 1. The U-shaped receptacle 2 and the tab 2C are located at opposite ends of the planar member 1. Alternatively, a second U-shaped receptacle may be used in place of the tab 2C, as shown in FIG. 8. When the teaching aid 10 is put in place on the club grip 3 the tab 2C is inserted into the hole at the top of the club grip 3. The U-shaped receptacle 2 receives the opposite end of the club grip 3.

The receptacle 2 of the planar member 1 in combination with the tab 2C and the inwardly facing projections 7 is capable of securing the teaching aid 10 to most any golf club grip 3 and permits the teaching aid 10 to be easily attached and removed from the club. Thus, the golfer can easily move the teaching aid 10 from one club to another without interfering in any way with a practice or training session or even during play.

As can be seen from the above, the teaching aid 10 is compact and portable and can therefore be easily transported in a golf bag for use at any time such as on a driving range or on a course during play. The teaching aid 10 is designed to give a golfer a visual picture of the true plane of the golfer's swing. The planar member 1 of the teaching aid 10, while preferably being minimally planar to provide a contrast, is preferably designed to not add any resistance to the golfer's swing, as well as not interfere with the golfer's hands positioned on the club grip 3. Thus, the planar member may have relatively small sides 1S and 1S' or may even be designed to be tubular, square, triangular, or any other design in cross-section. Preferably, there is a minimum of air resistance and a contrast is maintained to identify the orientation of the teaching aid 10 and thus the hands and club 12.

In operation, the teaching aid 10 provides the golfer, or a person other than the golfer, such as an instructor, with visual feedback of the position of the golfer's hands on the grip 3 of the club 12 at all times throughout the golfer's swing. According to the method of the present invention a golfer can learn to improve their golf swing by attaching the teaching aid 10 to the grip 3 of the club 12 and observing the position of the teaching aid relative to the golfer's hands and the golf club 12.

The teaching aid 10 is positioned on the club grip 3 such that it is substantially diagonal to the ground at the beginning of the golfer's swing by observing the edges 1A, 1A' and 1B of the planar member 1. At any point during the golfer's swing, the golfer and instructor can observe the teaching aid 10 and assess the position and orientation of the teaching aid 10 with respect to the golfer's hands and thus the club's 12 position and orientation. This helps to determine if the golfer needs to adjust an element of the swing to improve and obtain the proper positioning and orientation of the club and hands throughout the swing.

The method further contemplates the golfer stopping the swing at any time and observing the position of the teaching aid 10 with respect to the golfer's hands and the position of the club 12 to determine if any adjustments need to be made. The method further includes the steps of the instructor stopping a golfer at any point during the golfer's swing and observing and/or pointing to the teaching aid to show the golfer his hand position and orientation and to affirm or correct the golfer.

Because of the planar structure of the teaching aid, slight misalignments of the golfer's hands that are not easily seen nor felt by the golfer are exaggerated by the teaching aid and provide a reference point to which the player's hands may be correctly aligned which has not been possible prior to the present invention.

Although a particular embodiment of the present invention has been illustrated in the accompanying drawings and described in the foregoing detailed description, it is to be understood that the present invention is not to be limited to just the embodiment disclosed. Numerous rearrangements, modifications and substitutions arc possible, without departing from the scope of the following claims.

What is claimed is:

1. A device for use as an aid in perfecting a golf swing, said device enabling a golfer to determine an instantaneous position of the golfer's hands throughout the swing, said device for attaching to a golf club having a golf club grip, said device comprising:

a planar member having an opening, said opening of said planar member for surrounding the golf club grip such that the golfer's hands are positioned within said opening of said planar member when the golfer holds the golf club, said planar member having an edge visible to the golfer when said planar member is in position on the golf club grip; and means for removably attaching said planar member on the golf club grip, said removable attaching means being attached to said planar member.

2. The device of claim 1 wherein said removable attaching means comprises a first U-shaped member connected to said planar member, said U-shaped member forming an interference friction fit with the golf club grip when attached thereto.

3. The device of claim 2 wherein said U-shaped member comprises a first leg and a second leg, a first tab projecting perpendicular from said first leg of said U-shaped member, a second tab projecting perpendicular from said second leg of said U-shaped member and wherein the golf club grip is adapted to be located between the first and second tabs of the first and second legs, respectively.

4. The device of claim 2 wherein said removable attaching means further comprises a tab further defining said opening and located on said planar member separated from said U-shaped member, said tab being insertable in a hole in the end of the golf club grip.

5. The device of claim 1 wherein said removable attaching means comprises a first U-shaped member connected to said planar member and adapted to be connected to a golf club grip at a point distal from an end of the golf grip, said first U-shaped member forming an interference friction fit with said golf club grip when attached thereto: and a second U-shaped member connected to said planar member and adapted to be connected to a golf club grip at a point proximal said end of said golf grip, said second U-shaped member forming an interference fit with said golf club grip when attached thereto.

6. The device of claim 1 wherein said planar member and said removable attaching means are a one piece construction.

7. The device of claim 1 wherein said planar member further comprises an outer edge having a visual marking for sighting a position of the device throughout the golfer's swing.

8. A method of teaching a golfer how to swing a golf club, said method comprising the steps of:

removably attaching a planar member to a grip region of a golf club, said planar member having an opening for receiving the hands of the golfer, said planar member having a first edge contrasting with a side of said planar member;

aligning said first edge of said planar member with said golf club such that said golf club is in a proper position for hitting a golf ball;

gripping said golf club within said opening of said planar member by the golfer;

observing the alignment and orientation of said first edge by the golfer; and swinging said golf club by the golfer.

9. The method of claim 8 further comprising the step of observing said first edge of said planar member during said step of swinging said golf club.

10. The method of claim 8 further comprising the steps of maintaining said planar member perpendicular to the ground upon completion of a back-swing; and maintaining said planar member perpendicular to the ground upon completion of the follow through of the golf swing.

11. The method of claim 8 further comprising the step of stopping the golfer's swing and assessing the relative position of said planar member and adjusting the golfer's swing to obtain proper alignment of the planar member and thus the golf club.

12. The method of claim 8 further comprising the step of observing the position of said planar member at all times during the golfer's swing by a person other than the golfer for determining a true hand position during the golfer's swing and assisting the golfer in correcting the golf swing.

* * * * *

UNITED STATES PATENT AND TRADEMARK OFFICE

CERTIFICATE OF CORRECTION

PATENT NO. : 5,851,156
DATED : December 22, 1998
INVENTOR(S) : Orville J. Schwark, Jr.

It is certified that error appears in the above-identified patent and that said Letters Patent is hereby corrected as shown below:

Column 3, line 60, after "Fig. 7" kindly add a period ---- . ----.

Column 3, line 61, kindly delete "tab" and insert ----tabs----.

Column 4, line 12, kindly delete "end" and insert ----ends----.

Column 6, line 14, kindly delete "thereto:" and insert ----thereto;----.

Signed and Sealed this

Twenty-seventh Day of July, 1999

*Attest:*

Q. TODD DICKINSON

*Attesting Officer*

*Acting Commissioner of Patents and Trademarks*